United States Patent [19]

Shibata et al.

[11] 3,996,637

[45] Dec. 14, 1976

[54] APPARATUS FOR CLEANING THE INSIDE OF INGOT MOLDS OR OTHER HOLLOW BODIES HAVING INTERIORS OF VARYING SHAPES AND SIZES

[75] Inventors: Tatsuo Shibata; Yoshio Tanaka, both of Kitakyushu, Japan

[73] Assignee: Iri-E Kosan Corporation, Fukuoka, Japan

[22] Filed: June 13, 1975

[21] Appl. No.: 586,682

[52] U.S. Cl. ..... 15/56; 15/104.1 C; 15/104.14

[51] Int. Cl.[2] ..... B08B 9/08; B22D 43/00

[58] Field of Search ..... 15/56, 57, 58, 91, 93, 15/104.09, 104.1 C, 104.1 R, 104.14, 249

[56] References Cited

UNITED STATES PATENTS

| | | | |
|---|---|---|---|
| 962,370 | 6/1910 | Malick | 15/104.14 X |
| 1,767,795 | 6/1930 | Huff | 15/104.1 C |
| 2,181,306 | 11/1939 | Osborn | 15/104.14 |
| 3,280,416 | 10/1966 | Forsyth | 15/104.1 C |

FOREIGN PATENTS OR APPLICATIONS

| | | | |
|---|---|---|---|
| 1,430,525 | 1/1967 | France | 15/56 |
| 15,594 | 10/1972 | Japan | 15/104.1 C |

*Primary Examiner*—Edward L. Roberts
*Attorney, Agent, or Firm*—Frank J. Jordan

[57] ABSTRACT

The particular embodiment of the invention disclosed herein is specifically designed to clean the inside of a hollow body, especially, that of an ingot mold. For this purpose, the invention provides a cleaning apparatus comprising mainly a rotating means, an elevating means, a rotating shaft and a cleaning means for insertion into an ingot mold and the cleaning of the inside thereof.

10 Claims, 17 Drawing Figures

APPARATUS FOR CLEANING THE INSIDE OF INGOT MOLDS OR OTHER HOLLOW BODIES HAVING INTERIORS OF VARYING SHAPES AND SIZES

BACKGROUND OF THE INVENTION

This invention relates to an apparatus for cleaning the inside of all kinds of hollow bodies, more particularly to an apparatus for cleaning the inside of ingot molds to be used in iron or steel works or other places in order to produce ingots of good quality.

Heretofore, poured-type ingots have not only been difficult to remove from the molds but also the ingots have been of inferior quality due to the splashes of slag which stick to the walls of the ingot mold. This splashed slag instantly solidifies against the inside walls of the mold and causes the inside surface to become very rough and the subsequent pourings reflect this roughness.

The convention method for removing this slag on the inside wall of mold has been to employ human labor immediately after the removal of the ingot or periodically as required. However, this method not only requires a great deal of labor and time, but also involves a good deal of risk.

It is an object of the present invention to provide an apparatus which cleans the inside of an ingot mold and the like and makes the surface smooth by removing the solidified steel and slag adhering thereto so that ingots of good quality may be produced and removed easily from the mold. The present apparatus substantially comprises an elevating means, a rotating means, a rotating shaft and a cleaning means. This apparatus may be positioned either vertically or horizontally and is smoothly inserted into the inside of a hollow body such as an ingot mold for the purpose of cleaning the mold.

It is another object of the present invention to provide a cleaning means which substantially comprises flexible materials such as chains, spiny wires or ropes which are fixed to the rotating shaft. When the shaft is rotated, the cleaning means are twirled outward by centrifugal force causing the flixible materials to contact the inside surface of the ingot mold to clean such surface with an abrasive action.

Other features which are considered characteristic of the invention are set forth in the appended claims.

Although the invention is illustrated and described in relationship to specific embodiments, it is nevertheless not intended to be limited to the details shown, since various modifications and structural changes may be made therein without departing from the spirit of the invention and within the scope and range of equivalents of the claims.

The construction and operation of the invention, however, together with additional objects and advantages thereof, will be best understood from the following description of specific embodiments when read in connection with the accompanying drawings.

DETAILED DESCRIPTION OF THE INVENTION

FIRST EMBODIMENT

Figure 1A:
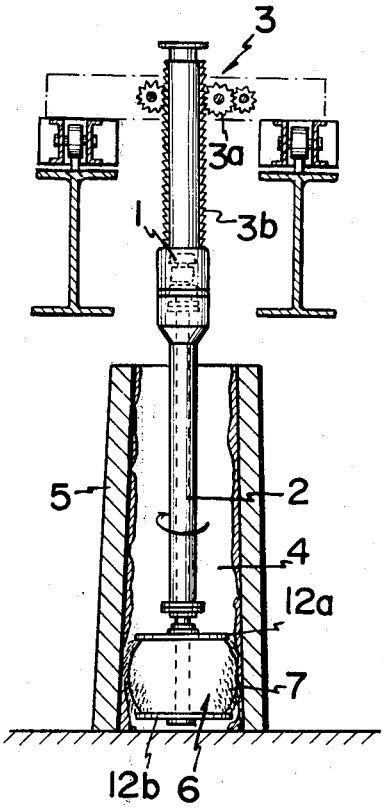
FIG. 1A is a front view of an apparatus according to a first embodiment of the present invention wherein the apparatus is shown cleaning the inside of an ingot mold.
Figure 1B:
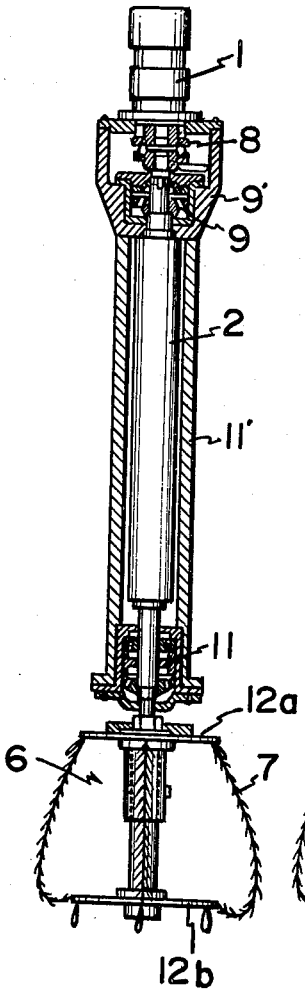
FIG. 1B is an expanded sectional view of the apparatus in FIG. 1A showing the rotating means and cleaning means in greater detail.

Referring to the construction of the apparatus of the first embodiment as shown in FIG. 1A and FIG. 1B, a rotating means 1 such as an electric motor or the like is shown which is operated to rotate a shaft 2 which is constructed so that one end of the shaft 2 is connected by coupling 8 to the shaft of rotating means 1.

An upper and a lower bearing means 9,11 are employed for the purpose of supporting shaft 2 radially as well as longitudinally and assuring the smooth rotating of shaft 2. Numeral 11' is a sleeve for protecting the rotating shaft 2.

Although the shaft 2 is shown vertically disposed in FIG. 1A, alternatively it may be horizontally disposed. An elevating means indicated generally as 3 has gears 3*a* engaging a rack 3*b* and is operable to cause rotating shaft 2 to move longitudinally along the interior surface 4 of a hollow body such as an ingot mold 5.

Attached to the lower part of the rotating shaft 2 as shown in FIG. 1B is a cleaning means 6 which comprises flexible members 7 and upper and lower rotary discs 12A and 12B.

Those upper and lower rotary discs 12A,12B are mounted on the lower end part of rotating shaft 2 at a desired spacing in such a way that the rotary discs 12A,12B can be moved towards and away from each other.

Figure 2A:
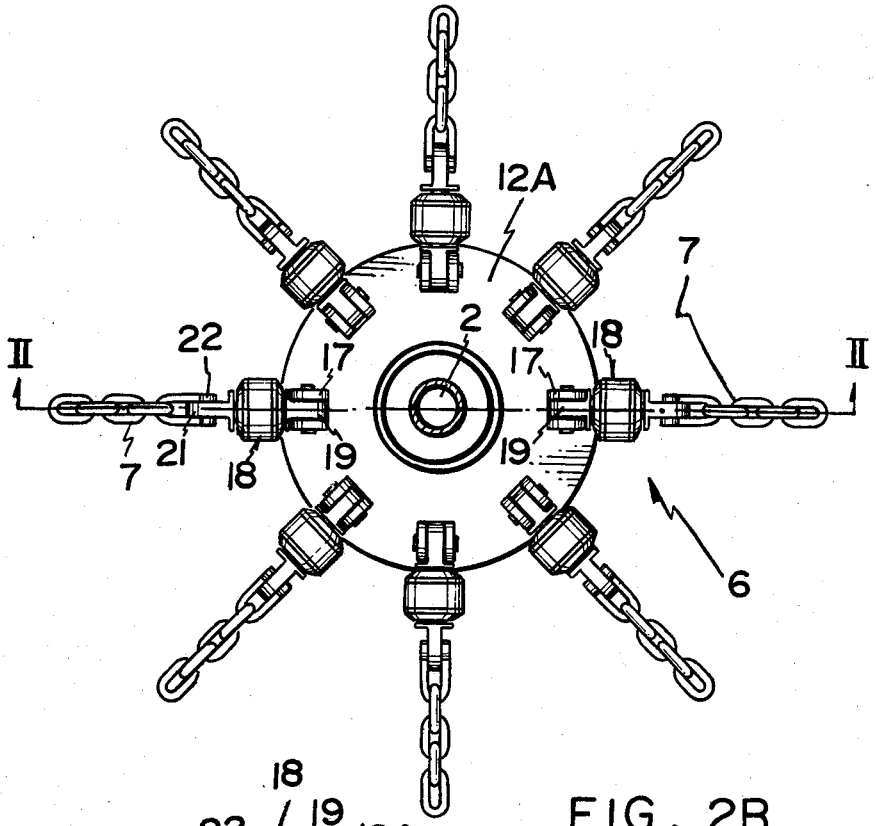
FIG. 2A is an expanded plan view of a cleaning means of the first embodiment.
Figure 2B:
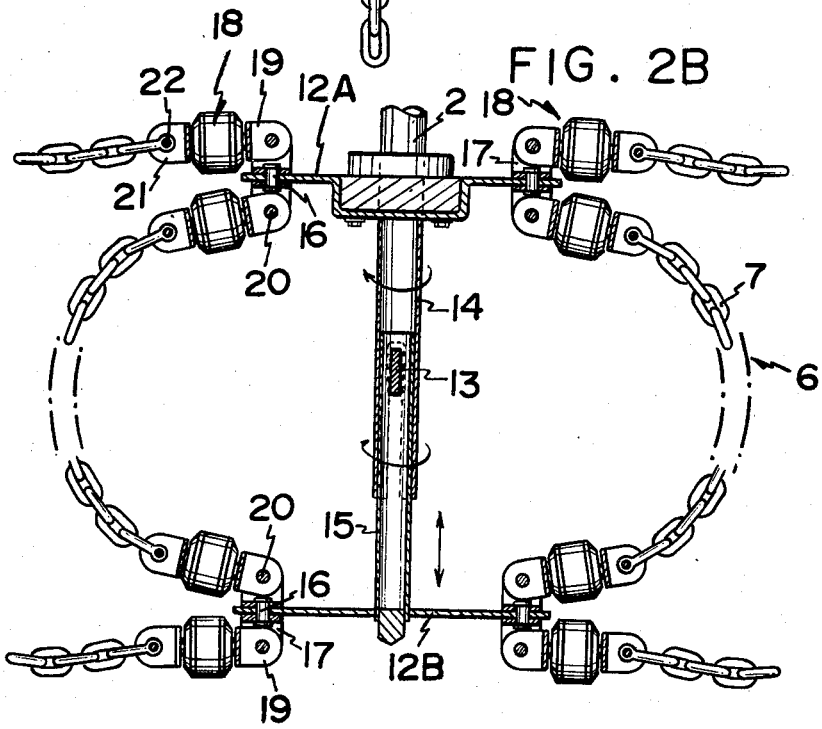
FIG. 2B is a cross sectional view of FIG. 2A taken on line II—II wherein upper and lower discs are mounted to move relative to each other as they are rotated and wherein the chains are mounted on the discs by universal joints.

A more detail explanation of the cleaning means 6 is described with reference to FIG. 2A,FIG. 2B, wherein the shaft 2 is fixed to the upper disc 12A which in turn is fixed to a hollow shaft 14, and the lower disc 12B is fixed to another hollow shaft 15 which telescopes into hollow shaft 14. A solid member 13 is employed to interconnect hollow shaft 15 to hollow shaft 14 in such a way the rotation of hollow shaft 15 is always dependent on that of hollow shaft 14.

A necessary number of flexible members 7 such as chains, cables, spiny wires, ropes, or the like of sufficient length are extended between the discs 12A and 12B, so that one end of the flexible members 7 is attached to the outer margin of the upper dics 12A and the other end to the outer margin of the lower disc 12B.

Each disc 12A, 12B has a plurality of vertically disposed pins 16 on which support brackets indicated generally as 17 are rotatably mounted. A connector 18 is provided which has a lug 19 that is pivotally connected to the chain 7 by a pin 22. It will be seen that the chain 7 is attached to the disc 12A,12B ny the bracket 17 and connector 18 which constitute a universal joint.

According to this first embodiment of the invention, the rotating shaft 2 is first lowered into the mold 5 by the elevating means 3 and then it is rotated by the rotating means 1. The upper and lower discs 12A and 12B can be removed towards or away from each other and the cleaning means 6 which is comprised of the chains or spiny wires 7 projects outward relative to the longitudinal axis of the rotating shaft 2 due to the centrifugal force cause by the rotation of the shaft 2. The cleaning means moves along the inner surface of an ingot mold thereby completely cleaning the inside surface of the ingot mold or another hollow body.

Furthermore, there is no danger that the rotating shaft 2 will bend or break even if the lower disc 12B contacts the bottom face of the mold 5. In addition, the flexible members 7 are pulled out by the weight of the lower disc 12B,so that the flexible members 7 do not slacken nor touch the inner surface of the mold when the cleaning means 6 is hoisted up to be moved onto the next ingot mold to be cleaned.

Still furthermore, the apparatus of this embodiment requires not only a small amount of maintenance owing to the simple construction of the cleaning means 6 but it is also relatively easy to change or replace the flexible members 7 when they are worn.

Figure 3:
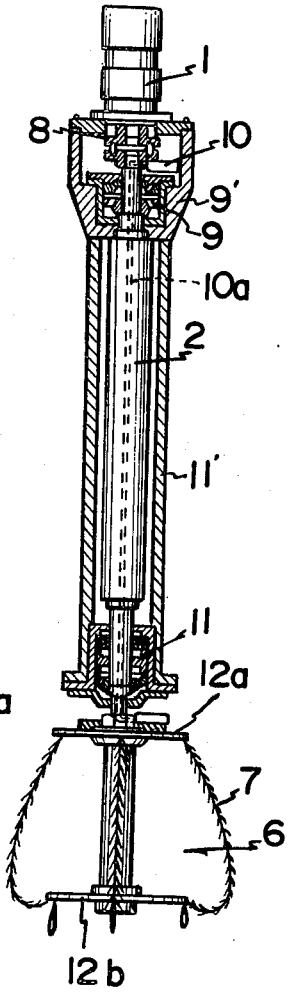
FIG. 3 is an expanded sectional view similar to FIG. 1B showing an oiling device and oil flow path which are provided for the apparatus.

Referring to FIG. 3, an oiling device 10 and a passage 10*a* in the shaft 2 is provided which allows the oil to pass to the cleaning means 6. The oiling device may be small of size so that it can be mounted in the bearing box 9′ and it is power-operated. This oiling means is employed for the purpose of oiling the entire inner surface 4 of the ingot mold 5 so that the next ingot which is casted in the ingot mold 5 can be smoothly removed.

SECOND EMBODIMENT

Figure 4A:
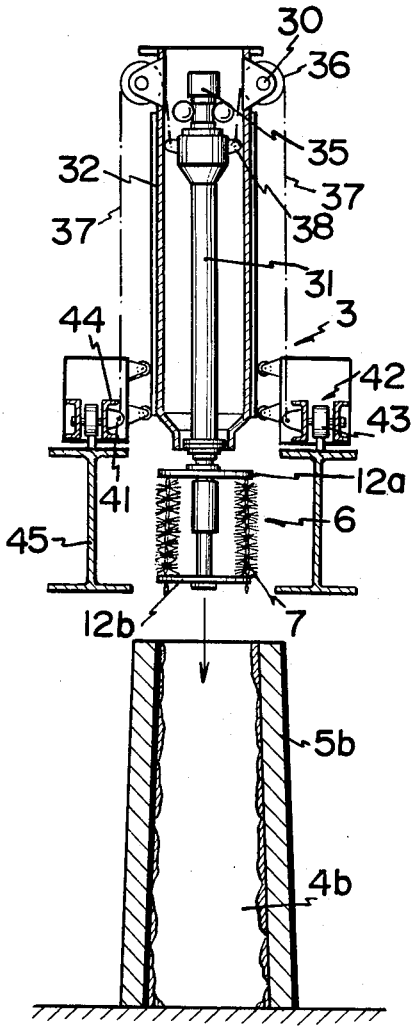
FIG. 4A is a front sectional view of an apparatus according to a second embodiment wherein the rotating shaft is enclosed within an outer cylindrical body.
Figure 4B:
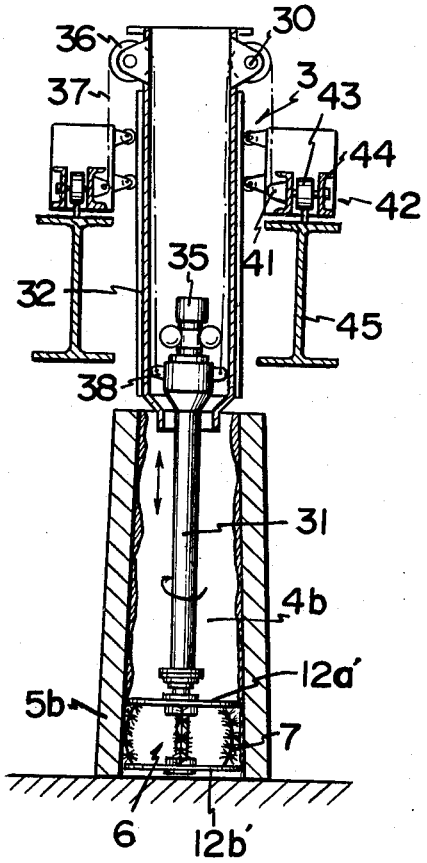
FIG. 4B is a front sectional view of the apparatus shown in FIG. 4A but wherein the position of the parts has been changed to show the apparatus in a position to clean the inside of an ingot mold.

As shown in FIG. 4A and FIG. 4B the second embodiment relates to an apparatus for cleaning the inside of hollow bodies and is characterized by a rotating shaft 31 which has an outer cylindrical body 32 which encloses the shaft 31.

Figure 4C:
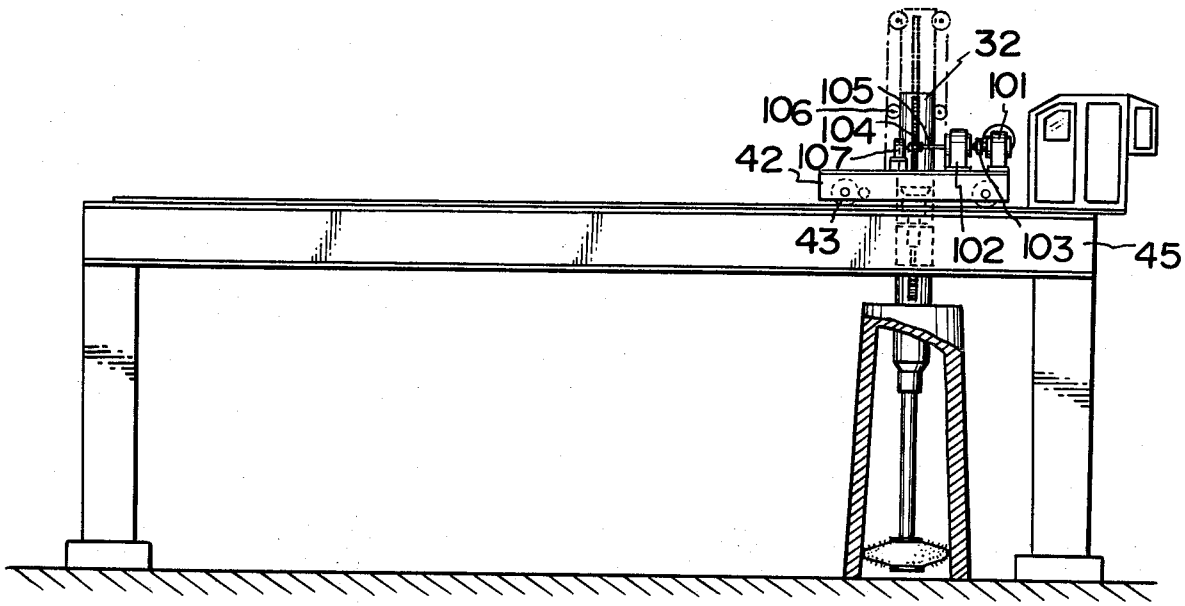
FIG. 4C is an elevational view of an apparatus, wherein the apparatus is mounted on a girder.

More detailed explanation of this embodiment is made with reference to FIG. 4A, FIG. 4B and FIG. 4C.

In FIG. 4A, FIG. 4B and FIG. 4C, numeral 31 is a rotating shaft which is suspended concentrially in an enclosing cylindrical body 32 by chains 37 which have one end fixed to lugs 38 which are secured to the outer surface of the rotating shaft 31 and the other end fixed to lugs 41 which are secured to the sides of channel frames 44.

Numeral 36 is a pulley which is journal-mounted on a shaft 30, which has both ends firmly fixed to amount on the outer surface of the cylindrical body 32. This pulley 36 is employed for suspending rotating shaft 31 as well as for lowering the shaft 31 downward from the cylindrical body 32. Numeral 35 indicates a rotating means such as an electric motor for rotating shaft 31. Numeral 42 is a transport car which comprises wheels 43 and channel frames 44. Numeral 45 is a girder on which transport car 42 is driven by a suitable means (not shown in figures).

Referring to FIG. 4C, numeral 101 is an elevating means or a motor and numeral 102 is a speed reduction device. Numeral 103 is a coupling which connects the shafts of both means 101 and 102 while numeral 104 is a pinion which is fixedly mounted on a shaft 105 and is engaged with a rack 106 which is located on the outer surface of the cylindrical body. One end of the shaft 105 is rotatably supported by a bearing 107.

In this embodiment, the transport car 42 has rotatable wheels 43 supported by channel frames 44 and is driven on girders 45 to a position where the apparatus is immediately over an ingot mold 5 to be cleaned. Then motor 101 is driven to lower cylindrical body 32 by means of rack 106 and pinion 104. Corresponding to the lowering of the cylindrical body 32 by a suitable means, the rotating shaft 31 is also lowered into the mold 5. Then the chain 37 moves to slide the rotating shaft 31 as well as the cleaning means 6 which is fixed to the lower end of the rotating shaft 31 downward from the cylindrical body 32. When the cylindrical body 32 reaches its lowest allowable position, the rotating shaft 31 also reaches its lowest position which is defined by the movement of the cylindrical body 32, wherein the cleaning apparatus of this embodiment can be telescopically extended to twice its original length.

Accordingly, this embodiment, besides possessing the advantage set forth for the first embodiment, also has the additional advantage that the rotating shaft 31 can be telescopically extended so that the apparatus is twice its original length and can be completely installed in a room or building without requiring a high roof or ceiling thereby making full use of the available space. FIG. 4A shows the apparatus in an elevated or withdrawn position while FIG. 4B shows the apparatus performing the cleaning operation in the ingot mold.

If it is necessary, the rotating shaft 31 can have more than two outer cylindrical bodies which are telescopically built so that the cleaning apparatus is a multistage telescoping apparatus which will thereby further increase the advantages of the second embodiment by providing for an even shorter over all height requirement. (Not shown in the figures).

THIRD EMBODIMENT

The third embodiment relates to an apparatus for cleaning the inside of hollow bodies which is characterized by the fact that the apparatus is mounted on the floor of a basement as shown in FIGS. 5A, 5B, 5C and 5D under a hollow body such as an ingot mold 5 so that the cleaning means is inserted upwardly into the hollow body 5.

In FIGS. 5A, 5B, 5C and 5D, numeral 51 indicates a basement on the floor of which the apparatus is mounted. The apparatus comprises a base 52, an elevating means 53, an elevating cylinder 55, a shaft 54 which has its lower portion connected to the driving shaft of the elevating means 53 and its upper portion, screw-threaded into a lower flange portion of the elevating cylinder 55, a rotating means 56 which is fixedly mounted on the top of the elevating cylinder 55, and a cleaning means 57 which is rotated by the rotating means 56. The elevating cylinder 55 is supported by rollers 58 which are rotably mounted to a lower face of a ceiling frame 59. These rollers permit the elevating cylinder 55 to pass upward but restrict any lateral movement. Numeral 60 indicates a means which allows the elevation of the cylinder 55 but restricts the rotation of the cylinder 55.

Figure 5A:
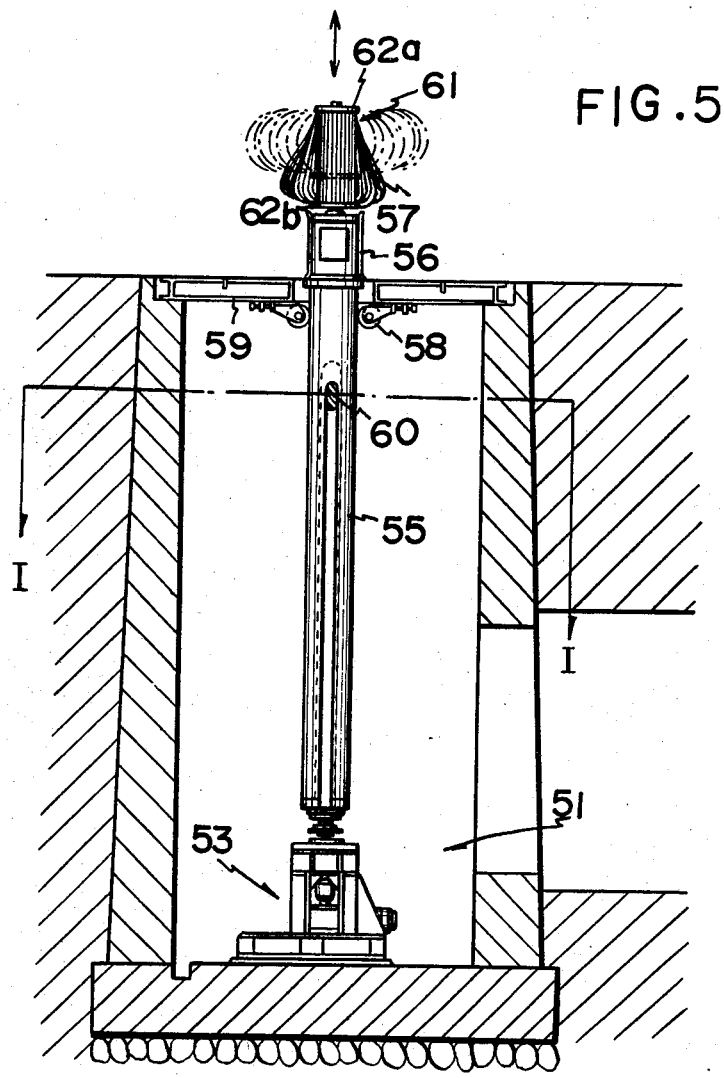
FIG. 5A is a front view of an apparatus according to a third embodiment of the present invention, wherein the apparatus is mounted on the floor so as to be able to clean the inside of an ingot mold by raising the cleaning means.
Figure 5C:
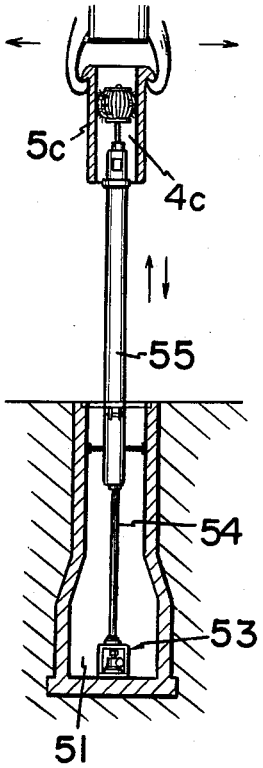
FIG. 5C is a front view of the above apparatus wherein the apparatus is in a position to clean the inside of an ingot mold.
Figure 5D:
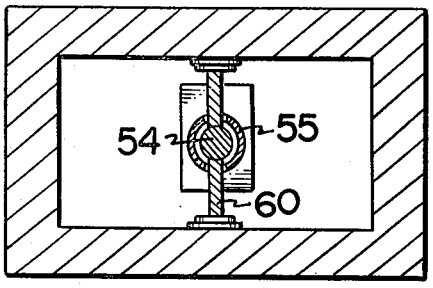
FIG. 5D is a cross sectional view taken along line 1—1 of FIG. 5A.
Figure 5B:
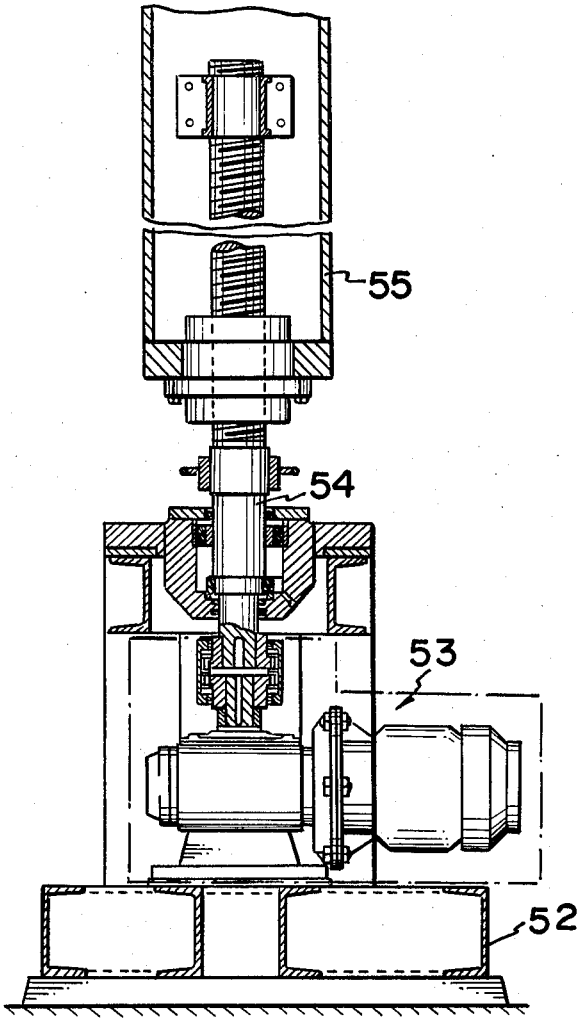
FIG. 5B is an expanded sectional view of FIG. 5A showing the elevating means of an apparatus in the section embodiment in detail.

In this embodiment, an ingot mold 5 is first carried and positioned by a suitable means such as a crane (not shown in FIG.) immediately over the apparatus as shown in FIG. 5A. Then the elevating means 53 is driven causing the shaft 54 to rotate. Due to the rotation of the shaft 54 which has its upper end portion threaded into the flange portion of the cylinder 55, the cylinder 55 is urged upward, wherein the rotation restricting means 60 stops the rotation of the cylinder 55.

The rotating means 56 as well as the cleaning means 57 are also raised. When the cleaning means 57 is raised into the mold 5, the rotating means 56 is driven rotating the cleaning means 57.

Accordingly, a flexible material 61 which is extended between the two discs 62*a*, 62*b* which can move toward and away from each other is projected outward in close contact with the interior surface 4 of the mold 5 so that the complete cleaning of the interior surface of the mold can be achieved.

According to this embodiment, besides the advantages set forth for the first and second embodiments, another advantage is that the basement of the workshop if available may be utilized.

With respect to the cleaning means which is employed in the above embodiments, several modifications are shown hereinafter referring to FIG. 6 and FIG. 8.

Figure 6:
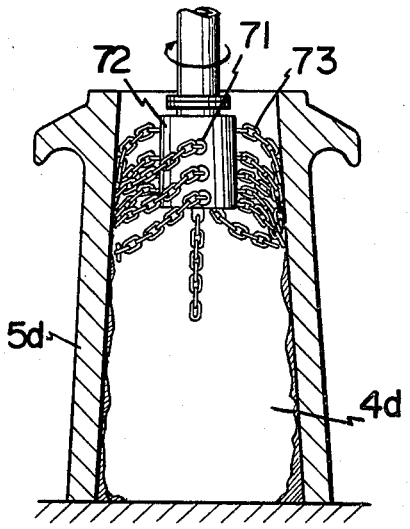
FIG. 6 is a front view of a cleaning means which can be utilized by all the preferred embodiments wherein a cylindrical body is fixed to the bottom end of a rotating shaft and a plurality of flexible members are attached to the outer surface of the cylindrical body.

FIG. 6 shows the construction of a cleaning means, wherein a necessary number of universal joints 71 of the type shown and described in above embodiments are fitted to the outside surface of a rotating cylindrical body 72 and a necessary number and suitable length of chains 73 are connected to the universal joints 71 at one end with the other end thereof being free. According to this cleaning means, metal links of the chain 73 strike and abrade the inside surface of an ingot mold as the cylindrical body 72 rotates easily removing the stubborn glue-like material or splash of smelted slag while the links of the chains move freely. The chains 73 themselves rotate due to the universal joints 71 so that the inside surface of the mold, regardless of its shape can be cleaned. Alternatively, spiny wires or ropes may be used instead of chains.

Figure 7:
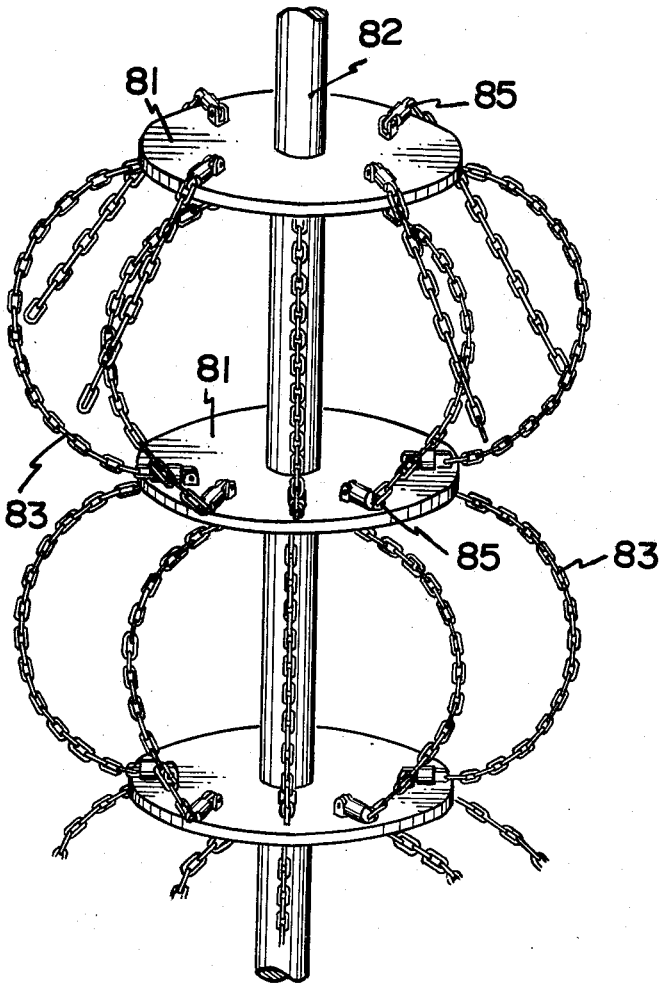
FIG. 7 is a perspective view of a cleaning means which can be utilized by all the preferred embodiments wherein a plurality of flexible members extend loosely between the discs in sequence.

FIG. 7 shows the construction of another cleaning means, wherein a plural number of rotary discs 81 are fixed to a rotating shaft 82 at regular intervals with the rotating shaft 82 passing through the center of each disc 81. A plurality of chains 83 are attached to the outer margin of each rotating disc 81 with one end being attached to the under side of an upper disc and the other end being attached to the upper side of the subsequent lower disc.

Universal joints 85 can be used as the connection between the chains 83 and the discs 81.

According to this cleaning means, it is possible to effect the complete cleaning of the inside surface of a mold.

Figure 8:
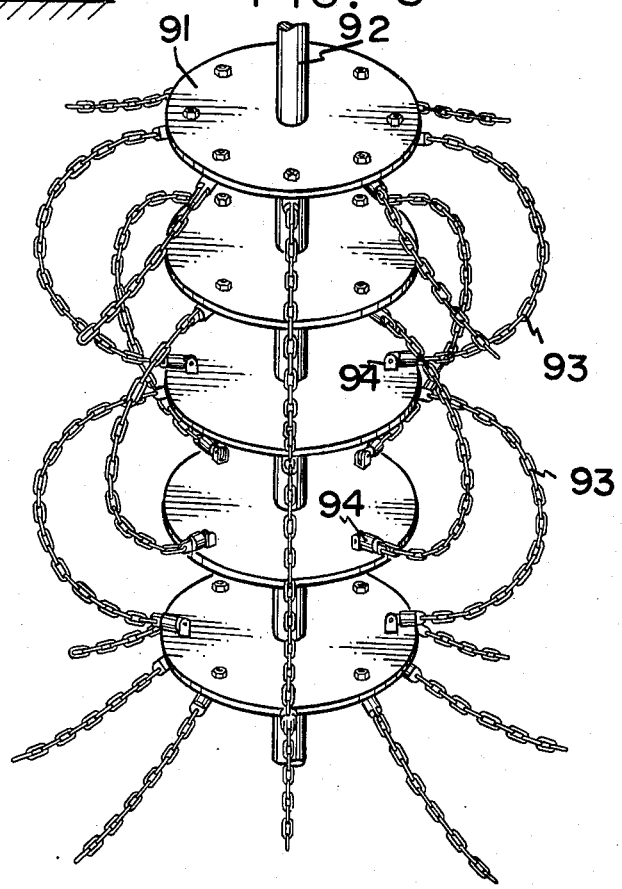
FIG. 8 is a perspective view of a cleaning means which can be utilized by all the preferred embodiments of this invention wherein a plurality of flexible members are extended loosely between every second disc in sequence.

FIG.8 shows the construction of another cleaning means, wherein a plurality of rotary discs 91 are fixed to the rotating shaft 92 at regular intervals with the rotating shaft 92 passing through the center of each disc 91, while a plurality of chains 93 are attached to the outer margin of each disc 91 with one end of the chain 93 being attached to the underside of an upper disc and the other end being attached to the upper side of a lower disc in such a way that the chains are attached to every other subsequent disc in the series.

Figure 9:
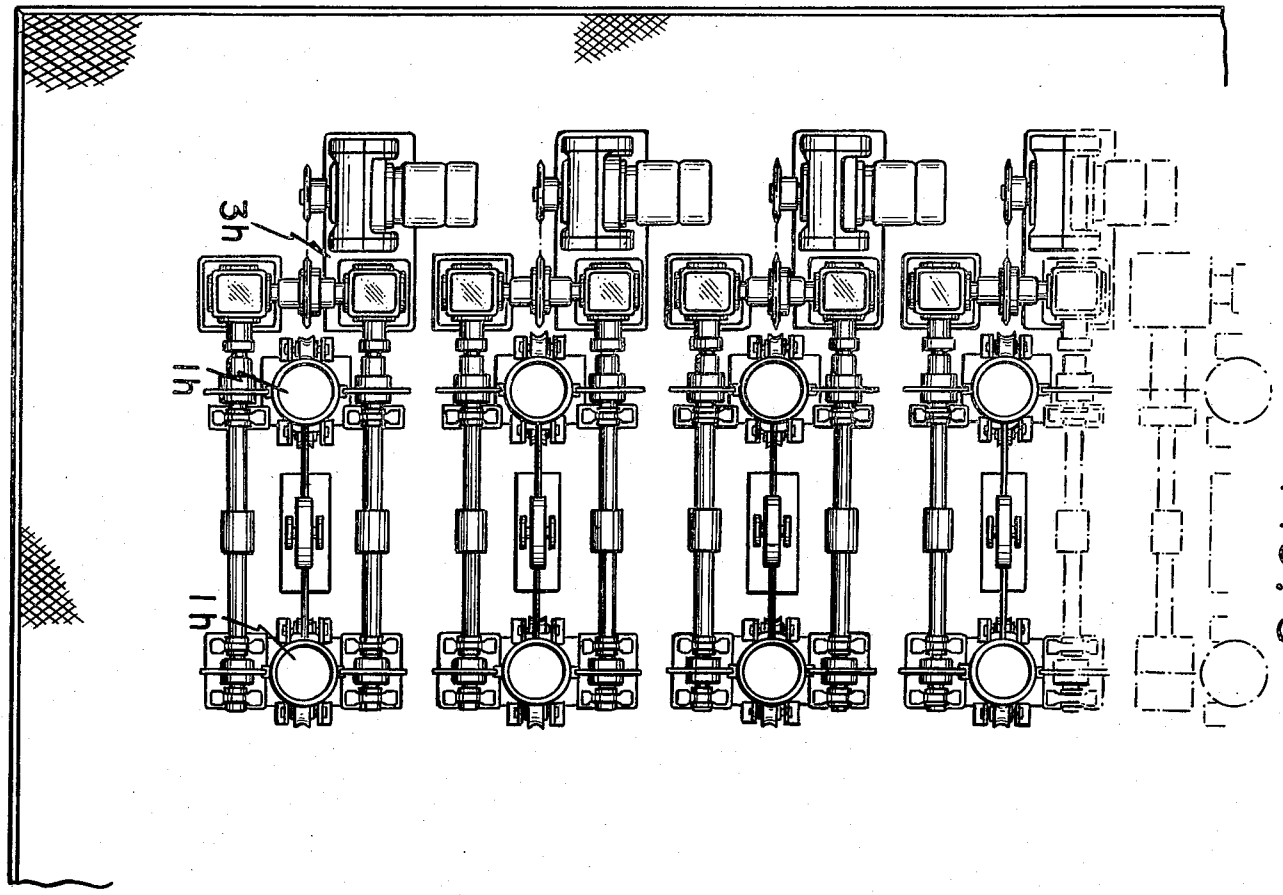
FIG. 9 is a plan view of a plurality of apparatus which are mounted on a movable support stand so as to simultaneously clean the inside of a plurality of ingot molds.
Figure 10:
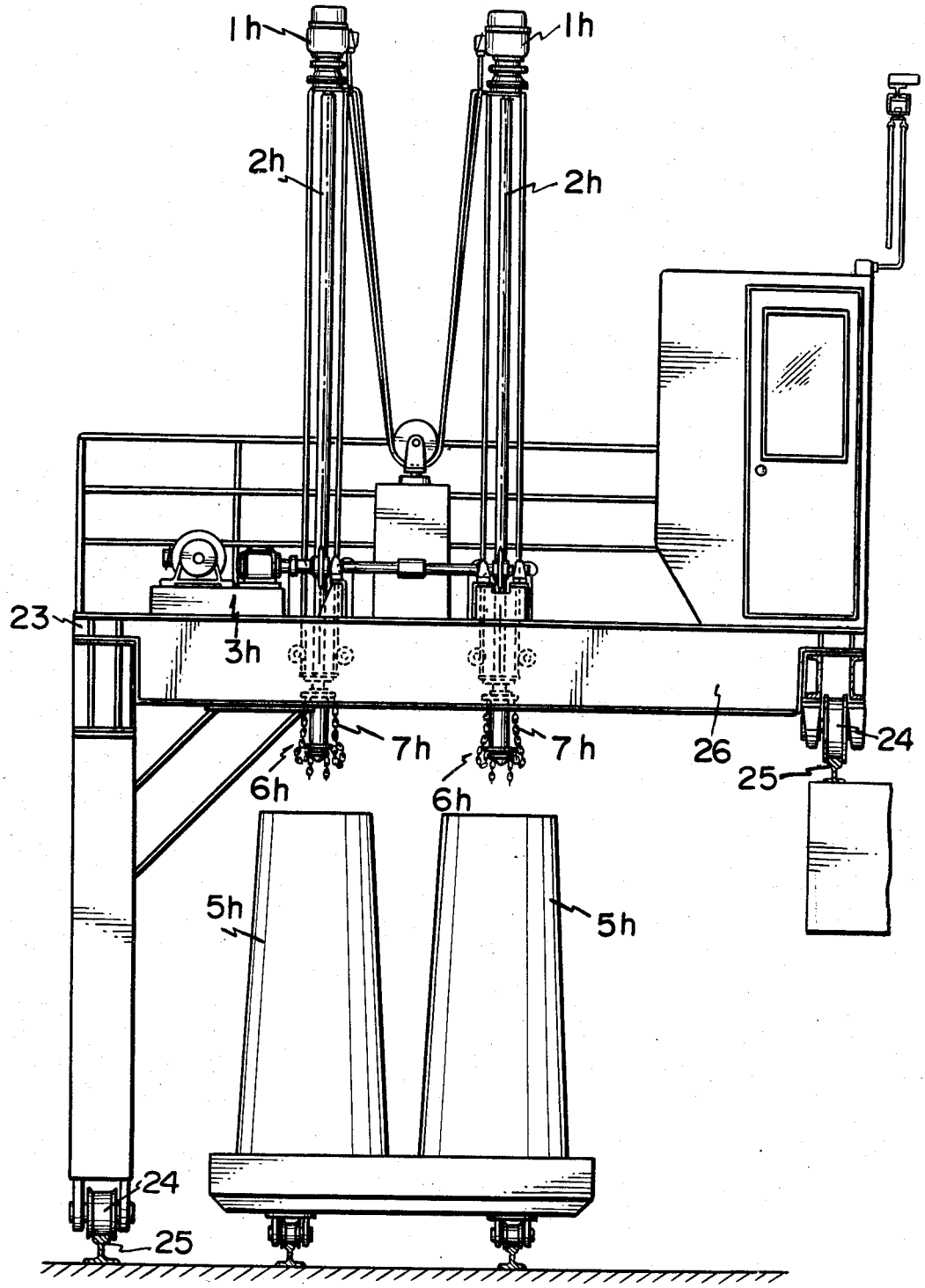
FIG. 10 is an elevational view of the apparatus shown in FIG. 9.

FIG. 9 and FIG. 10 refer to an arrangement of several pairs of apparatus of this invention for simultaneously cleaning the inside of a plurality of ingot molds which are aligned in series.

FIg.10 shows an elevated view of a pair of cleaning apparatus mounted on a movable support which is indicated generally as 23 and is movable by means of wheels 24 that are rotatable on tracks 25. The molds 5*h* to be cleaned are disposed beneath a cross member 26 of the movable support 23. As shown in FIG. 9, a plurality of pairs of apparatus are arranged to simultaneously clean the inside of a plurality of ingot molds 5*h*.

It is thought that the invention and may of its attendant advantages will be understood from the foregoing description and that it will be apparent that various changes may be made in the form, construction, and arrangements of the parts without departing from the spirit and scope of the invention or sacrificing all of its material advantages. The form heretofore described is merely a preferred embodiment thereof.

What is claimed is:

1. Apparatus for cleaning the inside of hollow bodies of varying sizes and shapes such as ingot molds and the like, comprising an elongated cylindrical body, first elevating means for raising and lowering said cylindrical body between a raised and a lowered position, a shaft concentrically disposed in said cylindrical body, said shaft being telescopically mounted in said cylindrical body for longitudinal displacement relative to said cylindrical body, second elevating means operably connected to said shaft for telescopically extending said shaft relative to said cylindrical body between an extended and a withdrawn position, said first elevating means and said second elevating means being operable to simultaneously lower said cylindrical body while telescopically extending said shaft relative to said cylinder body such that said shaft is extended to said extended position when said cylindrical body reaches its lowered position, said first elevating means and said second elevating means also being operable to simultaneously raise said cylindrical body while telescopically withdrawing said shaft such that said shaft is withdrawn to said withdrawn position when said cylindrical body reaches said raised position, rotating means on said shaft for rotating the latter, and cleaning means mounted on said shaft, said cleaning means comprising flexible members which are projected radially outwardly by centrifugal force as said shaft is rotated by said rotary means, said shaft being telescopically extendable to dispose said flexible members in a hollow body such that upon rotation of said shaft, said rotating and projected flexible members are operable to clean the inside of said hollow body.

2. Apparatus according to claim 1 wherein a structure is provided on which said apparatus is mounted, said first elevating means being mounted on said structure and engaging the outside of said cylindrical body for raising and lowering the latter.

3. Apparatus according to claim 2 wherein said second elevating means comprises a cable means having one end portion secured to said shaft and another end portion secured to said structure, and a pulley mounted on said cylindrical body over which an intermediate portion of said cable means passes, whereby lowering of said cylindrical body effects lowering of said pulley and simultaneous telescopic extension of said shaft relative to said cylindrical body.

4. Apparatus according to claim 1 wherein said cleaning means comprises at least three spaced rotary discs mounted on said shaft means, said flexible members being connected to the periphery of every other disc.

5. Apparatus according to claim 1 including means movably mounting said structure for horizontal displacement to thereby provide for displacing said apparatus to desired positions.

6. Apparatus according to claim 1 wherein at least two of all of said elements and means are provided to effect simultaneously clearing of at least two hollow bodies.

7. Apparatus for cleaning the inside of hollow bodies of varying sizes and shapes such as ingot molds and the like comprising an elongated cylindrical body, a threaded shaft telescopically received in said cylindrical body, thread engagement means on said cylindrical body threadedly engaging said threaded shaft such that rotation of said threaded shaft telescopically raises and lowers said cylindrical body relative to said threaded shaft, means for rotating said threaded shaft to thereby effect raising and lowering of said cylindrical body, a structure on which said apparatus is mounted, means extending between said structure and said cylindrical body to prevent rotation of said cylindrical body as said threaded shaft is rotated, cleaning means rotably mounted on said cylinder body and rotating means on said cylindrical body for rotating said cleaning means, said cleaning means comprising flexible members which are projected radially outwardly by a centrifugal force as said cylindrical body is rotated by said rotary means, said cylindrical body being telescopically extendable relative to said shaft to dispose said flexible members in a hollow body such that upon rotation of said shaft, said rotating and projected flexible members are operable to clean the inside of said hollow body.

8. Apparatus according to claim 7 wherein said means for preventing rotation of said cylindrical body includes at least one elongated slot in said cylindrical body and at least one fixed member disposed in said slot whereby said member precludes rotation of said cylindrical body while permitting longitudinal displacement of said cylindrical body.

9. Apparatus according to claim 7 including means on said structure supporting and guiding said cylindrical body as the latter is displaced relative to said structure.

10. Apparatus according to claim 7 wherein said cleaning means is disposed on an upper portion of said cylindrical body such that said cylindrical body is raised to dispose said cleaning means within an inverted hollow body.

* * * * *